US009777350B2

(12) United States Patent
Liu et al.

(10) Patent No.: US 9,777,350 B2
(45) Date of Patent: Oct. 3, 2017

(54) HIGH STRENGTH INTERSTITIAL FREE LOW DENSITY STEEL AND METHOD FOR PRODUCING SAID STEEL

(71) Applicant: TATA STEEL NEDERLAND TECHNOLOGY B.V., Velsen-Noord (NL)

(72) Inventors: Cheng Liu, Veslserbroek (NL); Radhakanta Rana, Golden, CO (US)

(73) Assignee: TATA STEEL NEDERLAND TECHNOLOGY B.V., Velsen-Noord (NL)

( * ) Notice: Subject to any disclaimer, the term of this patent is extended or adjusted under 35 U.S.C. 154(b) by 290 days.

(21) Appl. No.: 14/387,290

(22) PCT Filed: Apr. 10, 2013

(86) PCT No.: PCT/EP2013/057492

§ 371 (c)(1),
(2) Date: Sep. 23, 2014

(87) PCT Pub. No.: WO2013/153114

PCT Pub. Date: Oct. 17, 2013

(65) Prior Publication Data

US 2015/0047752 A1 Feb. 19, 2015

(30) Foreign Application Priority Data

Apr. 11, 2012 (EP) ..... 12163765

(51) Int. Cl.

| | |
|---|---|
| ***C22C 38/14*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C21D 8/02*** | (2006.01) |
| ***B21B 1/46*** | (2006.01) |
| ***B21B 3/02*** | (2006.01) |
| ***B21B 15/00*** | (2006.01) |
| ***B21B 45/00*** | (2006.01) |
| ***B22D 11/00*** | (2006.01) |
| ***C23C 2/02*** | (2006.01) |
| ***C25D 5/36*** | (2006.01) |

(52) U.S. Cl.

CPC ..... *C22C 38/14* (2013.01); *B21B 1/463* (2013.01); *B21B 3/02* (2013.01); *B21B 15/00* (2013.01); *B21B 45/004* (2013.01); *B22D 11/001* (2013.01); *C21D 8/0226* (2013.01); *C21D 8/0236* (2013.01); *C21D 8/0247* (2013.01); *C21D 8/0263* (2013.01); *C21D 8/0273* (2013.01); *C21D 9/46* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/12* (2013.01); *C23C 2/02* (2013.01); *C25D 5/36* (2013.01); *B21B 2015/0057* (2013.01); *C21D 2211/005* (2013.01); *Y10T 29/49991* (2015.01)

(58) Field of Classification Search

CPC ... C22C 38/001; C22C 38/002; C22C 38/004; C22C 38/02; C22C 38/04; C22C 38/06; C22C 38/12; C22C 38/14; B21B 1/463; B21B 3/02; B21B 15/00; B21B 45/004; B21B 2015/0057; C21D 8/0226; C21D 8/0236; C21D 8/0247; C21D 8/0263; C21D 8/0273; C21D 9/46; C21D 2211/005; C23C 2/02; B22D 11/001; C25D 5/36; Y10T 29/49991

See application file for complete search history.

(56) References Cited

U.S. PATENT DOCUMENTS

| | | | | |
|---|---|---|---|---|
| 5,348,701 | A | 9/1994 | Ohdake et al. | |
| 5,595,706 | A | 1/1997 | Sikka et al. | |
| 6,383,662 | B1 | 5/2002 | Frommeyer | |
| 2010/0300585 | A1* | 12/2010 | Perlade ..... | C21D 8/021 148/547 |
| 2015/0027597 | A1 | 1/2015 | Liu et al. | |

FOREIGN PATENT DOCUMENTS

| | | | |
|---|---|---|---|
| DE | 69329696 | T2 | 6/2001 |
| EP | 0495123 | A1 | 7/1992 |
| EP | 0620288 | A1 | 10/1994 |
| EP | 0719872 | A1 | 7/1996 |
| EP | 0826787 | A2 | 3/1998 |
| EP | 1811048 | A1 | 7/2007 |
| JP | H04232229 | A | 8/1992 |
| JP | 2001-271148 | A | 10/2001 |
| JP | 2005-029889 | A | 2/2005 |

(Continued)

OTHER PUBLICATIONS

International Search Report dated Jul. 24, 2013 from International Application PCT/EP2013/057492 to Tata Steel Nederland Technology B.V. filed Apr. 10, 2013.

(Continued)

*Primary Examiner* — Roy King

*Assistant Examiner* — Caitlin Kiechle

(74) *Attorney, Agent, or Firm* — Vorys, Sater, Seymour and Pease, LLP

(57) ABSTRACT

A high strength interstitial free low density steel and method for producing the steel.

20 Claims, 1 Drawing Sheet

(56) References Cited

FOREIGN PATENT DOCUMENTS

| | | | |
|---|---|---|---|
| JP | 2005120399 | A | 5/2005 |
| JP | 2006-176844 | A | 7/2006 |
| JP | 2007-321168 | A | 12/2007 |
| WO | 2013124264 | A1 | 8/2013 |

OTHER PUBLICATIONS

Meyer, Lutz, "Mikrolegierungselemente im Stahl", Thyssen Technische Berichte, Heft 1, 1984.—English Summary (p. 44).
Meyer, Lutz, "Neuere Entwicklungen bei weichen and hochfesten mikrolegierten Stählen", Zeitschrift für Metallkunde, Band 81, 1990.—English Abstract (p. 1).

* cited by examiner

| | A | B | C | D | E | F | G | H | I | J | K | L | M |
|---|---|---|---|---|---|---|---|---|---|---|---|---|---|
| 1 | C_total | 0.0015 | | | | | | | | | | | |
| 2 | S | 0.002 | | | X | 0.00075 | | =2*12/(2*32)*B2 | | | | | |
| 3 | Ti | 0 | | | Y | -0.00214 | | =2*12/(4*48)*(B3-48/14*B4) | | | | | |
| 4 | N | 0.005 | | | Z | -0.00579 | | =12/48*(B3-48/14*B4-4*48/(2*32)B2) | | | | | |
| 5 | Nb | 0 | | | | | | | | | | | |
| 6 | Zr | 0 | | | Minimum(X,Y) | | 0 | (=0 when result = negative) | | | | | Formlas in |
| 7 | V | 0 | | | Maximum(Z,0) | | 0 | (=0 when result = negative) | | | | | Excel |
| 8 | | | | | | | | | | | | | |
| 9 | | | | | C_solute | 0.0015 | | =B1-(F6+F7+12/93*B5+12/91*B6+12/51*B7) | | | | | |
| 10 | | | | | | | | | | | | | |
| 11 | For Claim 1 of application: | | | | If C_solute =<0, then there is no C in solid solution. | | | | | | | | |

HIGH STRENGTH INTERSTITIAL FREE LOW DENSITY STEEL AND METHOD FOR PRODUCING SAID STEEL

CROSS REFERENCE TO RELATED APPLICATIONS

This is a §371 U.S National Stage Application of International Application No. PCT/EP 2013/057492 filed on 10 Apr. 2013, claiming the priority of European Patent Application No. 12163765.6 filed on 11 Apr. 2012.

The invention relates to a high strength interstitial free low density steel and method for producing said steel.

In the continuing efforts to reduce the carbon emissions of vehicles the steel industry, together with the car manufacturers, continue to strive for steels which allow weight reduction without affecting the processability of the steels and the safety of the passengers. To meet future $CO_2$-emission requirements, the fuel consumption of automobiles has to be reduced. One way towards this reduction is to lower the weight of the car body. A steel with a low density and high strength can contribute to this. At the same thickness, the use of a low density steel reduces the weight of car components. A problem with known high strength steels is that their high strength compromises the formability of the material during forming of the sheet into a car component.

Ordinary high strength steels, for example dual phase steels, allow use of thinner sheets and therefore weight reduction. However, a thinner part will have a negative effect on other properties such as stiffness, crash—and dent resistance. These negative effects can only be solved by increasing the steel thickness, thus negating the effect of the downgauging, or by changing the geometry of the component which is also undesirable.

It is an object of this invention to provide a low density steel with a high strength in the finished component combined with excellent formability.

It is also an object of this invention to provide a high strength steel with excellent surface quality after forming.

One or more of these objects can be reached by providing an interstitial free ferritic steel strip or sheet comprising, in weight percent, up to 0.01% C_total;
up to 0.2% Si;
up to 1.0% Mn;
from 6 to up to 9% Al;
up to 0.010% N;
up to 0.080% Ti
up to 0.080% Nb;
up to 0.1% Zr;
up to 0.1% V;
up to 0.01% S;
up to 0.1% P;
up to 0.01% B
remainder iron and inevitable impurities;
wherein C_total<=Minimum[X,Y]
+Maximum[Z,0]
+12/93*Nb
+12/91*Zr
+12/51*V;
wherein
X=2*12/(2*32)*S;
Y=2*12/(4*48)*(Ti−48/14*N);
Z=12/48*(Ti−48/14*N−4*48/(2*32)*S);

wherein
Minimum[X,Y]=lower value of X and Y and Minimum [X,Y]=zero if Y is negative;
Maximum[Z,0]=higher value of zero and Z;
Wherein C_solute=C_total
Minimum[X,Y]
Maximum[Z,0]
12/93*Nb
12/91*Zr
12/51*V;
and wherein C_solute<=0.

All compositional percentages are in weight percent, unless otherwise indicated. C_total is the total carbon content in the steel. The steel according to the invention has a tailored chemical composition so as to eliminate the carbon in solid solution (C_solute) and the nitrogen in solid solution. This steel with no carbon or nitrogen in solid solution is called interstitial-free steel. This interstitial-free steel is strain ageing resistant, does not form so-called Lüders lines during forming the sheet into a car component and has high formability. The case where C_solute is negative indicates that there is an excess of carbon binding elements, and that in effect the amount of free carbon in solid solution (=C_solute) is zero.

For the sake of avoiding any unclarity the following should be noted:

X=2*12/(2*32)*S can also be written as X=2*((12/(2*32))*S);
Y=2*12/(4*48)*(Ti−48/14*N) can also be written as Y=2*(12/(4*48))*(Ti−((48/14)*N))
Z=12/48*(Ti−48/14*N−4*48/(2*32)*S) as Z=(12/48)*(Ti−(48/14*N)−((4*48/(2*32))*S))

93, 91 and 51 are the atomic masses of Nb, Zr and V respectively, and 12 is the atomic mass of C. The ratio 12/93, 12/91 and 12/51 is used to calculate how much carbon is consumed by Nb, Zr or V as a carbide and therefore the ratio of (e.g.) 12/93*Nb must be read as (12/93)*Nb. FIG. 1 shows an example of the calculation on the basis of prior art steel CA from JP2005-120399.

Titanium, as an alloying element or as an inevitable impurity, will first form TiN. If there is excess nitrogen, then the remaining nitrogen will be bound to aluminium. If there is excess titanium, then the remaining titanium will form $Ti_4C_2S_2$. After forming TiN and $Ti_4C_2S_2$, the remaining Ti will form TiC. The factor Minimum[X,Y] calculates how much carbon is consumed by the formation of $Ti_4C_2S_2$ after all free nitrogen was bound to TiN. If the calculation results in a negative value for Y, then the factor is to be set to zero. The factor Maximum[Z,0] calculates how much carbon is consumed by the formation of TiC.

If there is no titanium at all, no TiN or $Ti_4C_2S_2$ or TiC will be formed and then Minimum[X,Y] and Maximum[Z,0] amount to zero.

The other three factors account for the formation of NbC, ZrC and VC, and thereby together with the factors Minimum [X,Y] and Maximum[Z,0] determine the amount of solute carbon in the steel.

By adding no or only small amounts of titanium and/or a specified amount of Nb, the solute carbon will be eliminated.

The inventors found that to make interstitialfree steel, all carbon and nitrogen should be bounded to carbide and nitride forming elements.

JP2005-120399 discloses a steel having 0.0015% C, 0.05% Si, 0.45% Mn, 0.008% P, 7.5% Al and 0.005% N, the remainder being iron and inevitable impurities. FIG. 1 shows the calculation of C_solute according to the invention of this steel which is found to be 0.0015, because no carbon binding elements like Nb, Zr or V are present. C_solute is therefore not equal or smaller than zero, but instead it is larger than zero. Minimum[X,Y] and Maximum [Z,0] yield a value of zero in both cases.

The total carbon (C_total) is preferably at most 0.005%, and more preferably at most 0.004% and even more preferably at most 0.003%. The lower the total carbon, the smaller the amount of carbide forming elements needed. However a lower C_total becomes increasingly difficult to achieve, so there is a balance between the costs to reduce the carbon content to a lower value and the amount of expensive carbide forming elements that need to be added to eliminate the carbon in solid solution.

Nitrogen, in particularly free nitrogen (i.e. nitrogen in solid solution), is not desirable but unavoidable in steel making. It should therefore be kept as low as possible to reduce the amount of nitrogen binding elements needed to make the steel matrix free of free nitrogen and to reduce the amount of nitrides in the matrix as the shape of some nitrides, particularly titanium nitrides, is perceived to be undesirable. Consequently the inventors found that a maximum value of 50 ppm is preferable. Preferably the nitrogen content is at most 40 ppm, and more preferably the nitrogen content is at most 30 ppm.

The addition of Ti is beneficial for binding nitrogen, but not strictly necessary. Titanium, whether as an alloying element or as an inevitable impurity, will first form TiN. If there is excess nitrogen, then the remaining nitrogen will be bound to aluminium. However, the large amount of aluminium in the steel can also ensure that all nitrogen is bound. This means that the matrix is substantially free of nitrogen in solid solution. TiN are cubic hard precipitates and may form crack initiations. Consequently, it is preferable that the amount of titanium is kept as low as possible to prevent the undesirable effects of TiN-precipitates. Up to 0.08% Ti can be added to the steel, to bind nitrogen into TiN and to control the amount of solute carbon.

In an embodiment, the titanium content is 0.019% or lower, e.g. at most 0.018% or 0.015% or even at most 0.012%. As described hereinabove, it may be preferable for some applications to limit the amount of TiN-precipitates. Particularly, but not solely, in combination with a low nitrogen content a low titanium content is preferable. If the amount of titanium is not enough to bind all nitrogen, then the aluminium in the steel will take over and bind the nitrogen as aluminium-nitride.

Boron is added to high strength interstitial steels to reduce cold working embrittlement and/or to contribute to the strength.

According to an embodiment the composition of the ferritic steel according to the invention has a base composition of, up to 0.2% Si;
up to 1.0% Mn;
from 6 to up to 9% Al;
up to 0.010% N;
up to 0.08% Nb;
up to 0.1% Zr;
up to 0.1% V;
up to 0.01% S;
up to 0.1% P;
up to 0.01% B;
remainder iron and inevitable impurities;

In this embodiment no titanium is added as an alloying element to the steel and any titanium present in trace amounts is an inevitable impurity as a result of the steelmaking process. This embodiment covers the case where the amount of TiN-particles is to be kept at a minimum.

In an embodiment of the invention the manganese content is at least 0.1%. In another embodiment the aluminium content is at least 6% and/or at most 9%, preferably at most 8.5%. Preferably the aluminium content is at least 6.5% and/or at most 8.0%.

In an embodiment of the invention the silicon content is at most 0.05%. During the annealing process silicon can segregate on the steel surface to form nanometer-sized oxides. Because these oxides show poor wettability by liquid zinc, uncoated (bare) spots are sometimes found on the surfaces of such steels after they are hot-dip galvanized. Consequently, for instance for these applications the silicon content is preferably limited to at most 0.05%.

Steel according to any one of the preceding claims wherein the specific density of the steel is between 6800 and 7300 kg/m$^3$. As a result of the aluminium additions the specific density of the steel is reduced.

The steel is preferably calcium treated. The chemical composition may therefore also contain calcium in an amount consistent with a calcium treatment.

In the steels according to the invention the amount of carbon in solid solution is controlled by the addition of microalloying elements (Ti, Nb, V, Zr) in combination with excellent control of the total carbon content in the steel.

The amount of Ti or Nb should be strictly controlled. Too much titanium or niobium will increase costs and too low titanium or niobium can not bind all nitrogen and carbon into nitride and carbide.

If titanium is added as an alloying element, a suitable minimum value for the titanium content is 0.005%. A suitable minimum value for Nb is 0.004%. For V and Zr suitable minimum values are 0.002% and 0.004% respectively.

According to a second aspect, a method for producing an interstitial free ferritic steel strip is provided comprising the steps of:

providing a steel slab or thick strip by:
- continuous casting, or
- by thin slab casting, or
- by belt casting, or
- by strip casting;

optionally followed by reheating the steel slab or strip at a reheating temperature of at most 1250° C.;

hot rolling the slab or thick strip and finishing the hot-rolling process at a hot rolling finishing temperature of at least 850° C.;

coiling the hot-rolled strip at a coiling temperature of between 500 and 750° C.

In preferable embodiment the coiling temperature is at least 600° C. and/or the hot rolling finishing temperature is at least 900° C.

This hot-rolled strip can be subsequently further processed in a process comprising the steps of:

cold-rolling the hot-rolled strip at a cold-rolling reduction of from 40 to 90% to produce a cold-rolled strip;

annealing the cold-rolled strip in a continuous annealing process at a peak metal temperature of between 700 and 900° C. or in a batch annealing process at a top temperature between 650 and 800° C.;

optionally galvanising the annealed strip in a hot-dip galvanising or electro-galvanising or a heat-to-coat process.

The hot-rolled strip is usually pickled and cleaned prior to the cold-rolling step. In an embodiment the peak metal temperature in the continuous annealing process is at least 750° C., preferably at least 800° C.

In an embodiment the cold rolling reduction is at least 50%.

In an embodiment the thickness cold-rolled strip is between 0.4 and 2 mm.

The invention is now further explained by means of the following, non-limiting examples.

Steels were produced and processed into cold-rolled steel sheets having a thickness of 1 mm. The hot rolled strip had a thickness of 3.0 mm. The chemical composition of the steels is given in Table 1.

TABLE 1

Chemical composition in 1/1000 wt. % (except Al in wt. %)

| Steel | C | Al | Mn | Si | P | N | Ti | Nb | Zr | V | S | B | C_solute | |
|---|---|---|---|---|---|---|---|---|---|---|---|---|---|---|
| 1 | 2.5 | 8.0 | 220 | 10 | 1 | 4 | 45 | tr | tr | tr | 4 | 1.5 | 0.000 | I |
| 2 | 3 | 7.0 | 220 | 10 | 1 | 3 | 15 | 25 | tr | tr | 4 | tr | 0.000 | I |
| 3 | 3 | 8.0 | 210 | 10 | 1 | 3 | 12 | 25 | tr | tr | 4 | 1.5 | 0.000 | I |
| 4 | 3 | 7.0 | 220 | 10 | 1 | 3 | tr | 30 | tr | tr | 4 | 1.5 | 0.000 | I |
| 5 | 4 | 7.5 | 200 | 10 | 1 | 4 | 15 | tr | tr | 20 | 4 | tr | 0.000 | I |
| 6 | 4 | 7.0 | 210 | 10 | 1 | 3 | 15 | tr | 30 | tr | 4 | tr | 0.000 | I |
| 7 | 4 | 0.05 | 700 | 220 | 90 | 3 | 45 | tr | tr | tr | 5 | tr | 0.000 | R |
| 8 | 10 | 7.0 | 200 | 10 | 1 | 3 | 15 | 25 | tr | tr | 5 | 1.5 | 6.2 | R |

(I = invention, R = reference) (tr = trace, inevitable impurity, C_solute = carbon in solid solution).

The steels were produced by casting a slab and reheating the slab at a temperature of at most 1250° C. This temperature is the maximum temperature, because at higher reheating temperatures excessive grain growth may occur. The finishing temperature during hot rolling was 900° C., coiling temperature 700° C., followed by pickling and cold rolling (67%) and continuous annealing at a peak metal temperature of 800° C. and hot-dip-galvanising.

TABLE 2

Mechanical properties (NA = natural ageing)

| steel | YLD (MPa) | UTS (MPa) | A80 (%) | NA | Density (kg/m$^3$) |
|---|---|---|---|---|---|
| 1 | 410 | 530 | 25 | − | 7110 |
| 2 | 345 | 465 | 31 | − | 7210 |
| 3 | 420 | 530 | 22 | − | 7110 |
| 4 | 351 | 470 | 30 | − | 7210 |
| 5 | 408 | 518 | 23 | − | 7160 |
| 6 | 349 | 468 | 29 | − | 7210 |
| 7 | 291 | 396 | 36 | − | 7850 |
| 8 | 359 | 475 | 29 | + | 7210 |

The invention claimed is:

1. An Interstitial free ferritic steel strip or sheet comprising, in weight percent, up to 0.01% C_total, wherein C_total is a total carbon content in the steel;
up to 0.2% Si;
up to 1.0% Mn;
from 6 to 9% Al;
up to 0.010% N;
up to 0.018% Ti
up to 0.080% Nb;
up to 0.1% Zr;
up to 0.1% V;
up to 0.01% S;
up to 0.1% P;
up to 0.01% B
remainder iron and inevitable impurities;
wherein C_total<=Minimum[X,Y]
+Maximum[Z,0]
+12/93*Nb
+12/91*Zr
+12/51*V;
wherein
X=2*12/(2*32)*S;
Y=2*12/(4*48)*(Ti−48/14*N);
Z=12/48*(Ti−48/14*N−4*48/(2*32)*S);
wherein Minimum[X,Y]=lower value of X and Y and Minimum[X,Y]=zero if Y is negative;
Maximum[Z,0]=higher value of zero and Z;
C_solute=C_total
Minimum[X,Y]
Maximum[Z,0]
12/93*Nb
12/91*Zr
12/51*V;
and wherein C_solute is equal to or smaller than zero.

2. The steel according to claim 1, wherein the steel comprises titanium only as an inevitable impurity in at most a trace amount.

3. The steel according to claim 1, wherein Al is at least 6.5% and/or at most 8.5%.

4. The steel according to claim 1, wherein N is at most 0.004% (40ppm).

5. The steel according to claim 1, wherein Mn is at least 0.1% and/or Si is at most 0.05%.

6. The steel according to claim 1, wherein the specific density of the steel is between 6800 and 7300 kg/m 3.

7. The steel according to claim 1, wherein the steel is a cold-rolled steel sheet.

8. A method for producing an interstitial free ferritic steel strip comprising the steps of:

providing a steel slab or thick strip, optionally calcium treated, by:
continuous casting, or
by thin slab casting, or
by belt casting, or
by strip casting;
the steel comprising, in weight percent,
up to 0.01% C_total, wherein C_total is a total carbon content in the steel;
up to 0.2% Si;
up to 1.0% Mn;
from 6 to 9% Al;
up to 0.010% N;
up to 0.018% Ti
up to 0.080% Nb;
up to 0.1% Zr;
up to 0.1% V;
up to 0.01% S;

up to 0.1% P;
up to 0.01% B
remainder iron and inevitable impurities;
wherein C_total<=Minimum[X,Y]
+Maximum[Z,0]
+12/93*Nb
+12/91*Zr
+12/51*V;
wherein
X=2*12/(2*32)*S;
Y=2*12/(4*48)*(Ti−48/14*N);
Z=12/48*(Ti−48/14*N−4*48/(2*32)*S);
wherein
Minimum[X,Y]=lower value of X and Y and Minimum [X,Y]=zero if Y is negative;
Maximum[Z,0]=higher value of zero and Z;
C_solute=C_total
Minimum[X,Y]
Maximum[Z,0]
12/93*Nb
12/91*Zr
12/51*V;
and wherein C_solute is equal to or smaller than zero;
optionally followed by reheating the steel slab or strip at a reheating temperature of at most 1250° C.;
hot rolling the slab or thick strip and finishing the hot-rolling process at a hot rolling finishing temperature of at least 850° C. to form a hot rolled ferritic strip;
coiling the hot-rolled strip at a coiling temperature of between 600 and 750° C.

9. The method according to claim 8, wherein the steel comprises at most 0.012% titanium.

10. The method according to claim 8, wherein the steel comprises titanium only as an inevitable impurity in at most a trace amount.

11. The method according to claim 8, wherein the hot-rolled strip is reheated in:
a continuous annealing step, optionally followed by hot-dip galvanizing followed by cooling, or
a heat-to-coat step, followed by hot-dip galvanising and cooling.

12. The method according to claim 8 comprising:
cold-rolling the hot-rolled ferritic steel strip of claim 8 at a cold-rolling reduction of from 40 to 90% to produce a cold-rolled strip;
annealing the cold-rolled strip in a continuous annealing process with a peak metal temperature of between 700 and 900° C. or in a batch annealing process at a top temperature between 650 and 800° C.;
optionally galvanising the annealed strip in a hot-dip galvanising or electro-galvanising or a heat-to-coat process.

13. The method according to claim 12, wherein the peak metal temperature in the continuous annealing process is 750° C. to 900° C.

14. The method according to claim 12, wherein the cold rolling reduction is at least 50%, and/or the thickness of the cold-rolled strip is between 0.4 and 2 mm.

15. The method according to claim 8, wherein Al is 6.5% to 8.5%.

16. The method according to claim 8, wherein N is at most 0.003% (30 ppm).

17. The method according to claim 12, wherein the peak metal temperature in the continuous annealing process is 800° C. to 900° C.

18. The method according to claim 8, wherein the steel comprises no titanium.

19. The method according to claim 8, wherein the steel comprises up to 0.005% C_total.

20. The method according to claim 8, wherein the steel comprises up to 0.003% C_total.

* * * * *